US008292717B1

(12) United States Patent
Goldscheider

(10) Patent No.: US 8,292,717 B1
(45) **Date of Patent: *Oct. 23, 2012**

(54) SYSTEM AND METHOD FOR PROVIDING A GAME OF CHANCE OVER MESSAGING SERVICES

(75) Inventor: Daniel Goldscheider, Lachen (CH)

(73) Assignee: Lottelo AG, Lachen (CH)

( * ) Notice: Subject to any disclaimer, the term of this patent is extended or adjusted under 35 U.S.C. 154(b) by 282 days.

This patent is subject to a terminal disclaimer.

(21) Appl. No.: 12/618,503

(22) Filed: Nov. 13, 2009

Related U.S. Application Data

(63) Continuation-in-part of application No. 12/421,369, filed on Apr. 9, 2009.

(51) Int. Cl.
*A63F 9/00* (2006.01)

(52) U.S. Cl. ..... 463/16

(58) Field of Classification Search ..... None
See application file for complete search history.

(56) References Cited

U.S. PATENT DOCUMENTS 6,688,982 B2 * 2/2004 Moodie et al. ..... 463/41
7,035,626 B1 * 4/2006 Luciano, Jr. ..... 455/414.1
7,125,336 B2 * 10/2006 Anttila et al. ..... 463/40
2002/0160825 A1 * 10/2002 Nicastro et al. ..... 463/16
2005/0043089 A1 * 2/2005 Nguyen et al. ..... 463/29
2006/0183549 A1 * 8/2006 Chow et al. ..... 463/42
2006/0242008 A1 10/2006 Harris et al.
2007/0117608 A1 * 5/2007 Roper et al. ..... 463/16
2007/0213118 A1 * 9/2007 Karmazin ..... 463/17
2007/0249420 A1 10/2007 Randall
2008/0058057 A1 * 3/2008 Lau et al. ..... 463/17
2008/0132314 A1 * 6/2008 Robb et al. ..... 463/17
2009/0082081 A1 * 3/2009 Walker et al. ..... 463/17
2009/0176549 A1 * 7/2009 Saig et al. ..... 463/17
2009/0221358 A1 * 9/2009 Alldredge et al. ..... 463/25
2009/0227315 A1 * 9/2009 Larue ..... 463/16
2010/0004045 A1 * 1/2010 Roemer ..... 463/16

* cited by examiner

*Primary Examiner* — Melba Bumgarner
*Assistant Examiner* — Seng H Lim
(74) *Attorney, Agent, or Firm* — Brinks Hofer Gilson & Lione

(57) ABSTRACT

A system and method are described for providing a game of chance over messaging services. In one embodiment a method is disclosed for receiving a message from a first user which includes an identifier of a second user. The second user is registered for the game of chance based on the identifier of the first user. A message may be sent to the second user to invite the second user to enter the identifier of another user into the game of chance. A winning identifier is identified from a set of identifiers, such as the identifiers entered into the game of chance. A message is sent the second user if the amount by which the identifier of the first user matches the winning identifier satisfies a winning threshold. The message may include an indication that the second user won a prize.

25 Claims, 9 Drawing Sheets

700

800

SYSTEM AND METHOD FOR PROVIDING A GAME OF CHANCE OVER MESSAGING SERVICES

CROSS-REFERENCE TO RELATED APPLICATIONS

This application is a continuation-in-part of U.S. patent application No. 12/421,369, filed on Apr. 9, 2009, which is incorporated by reference herein.

BACKGROUND

The mobile phone may be increasingly important as an information and content access device. Mobile phones may be used for phone calls, messaging, such as short messaging service (SMS) messaging, multimedia messaging service (MMS) messaging, and email, and to browse the web. These features provide the users of the mobile devices access to other people and to content. Carriers may be introducing content services, multimedia services and applications, such as games, as a means of generating new revenue streams, retaining and attracting customers, increasing returns on investment, and extending and differentiating their service offerings to consumers. The emergence of these new services may be creating unique opportunities for mobile carriers and publishers to generate additional revenue streams through new and existing customers. Advancements in mobile phone technology have allowed carriers to provide graphics rich games and multimedia content to mobile phone users. However, the majority of mobile phone users may not have mobile devices capable of accessing these games and content.

BRIEF DESCRIPTION OF THE DRAWINGS

The system and/or method may be better understood with reference to the following drawings and description. Non-limiting and non-exhaustive descriptions are described with reference to the following drawings. The components in the figures are not necessarily to scale, emphasis instead being placed upon illustrating principles. In the figures, like referenced numerals may refer to like parts throughout the different figures unless otherwise specified.

DETAILED DESCRIPTION

Figure 1:
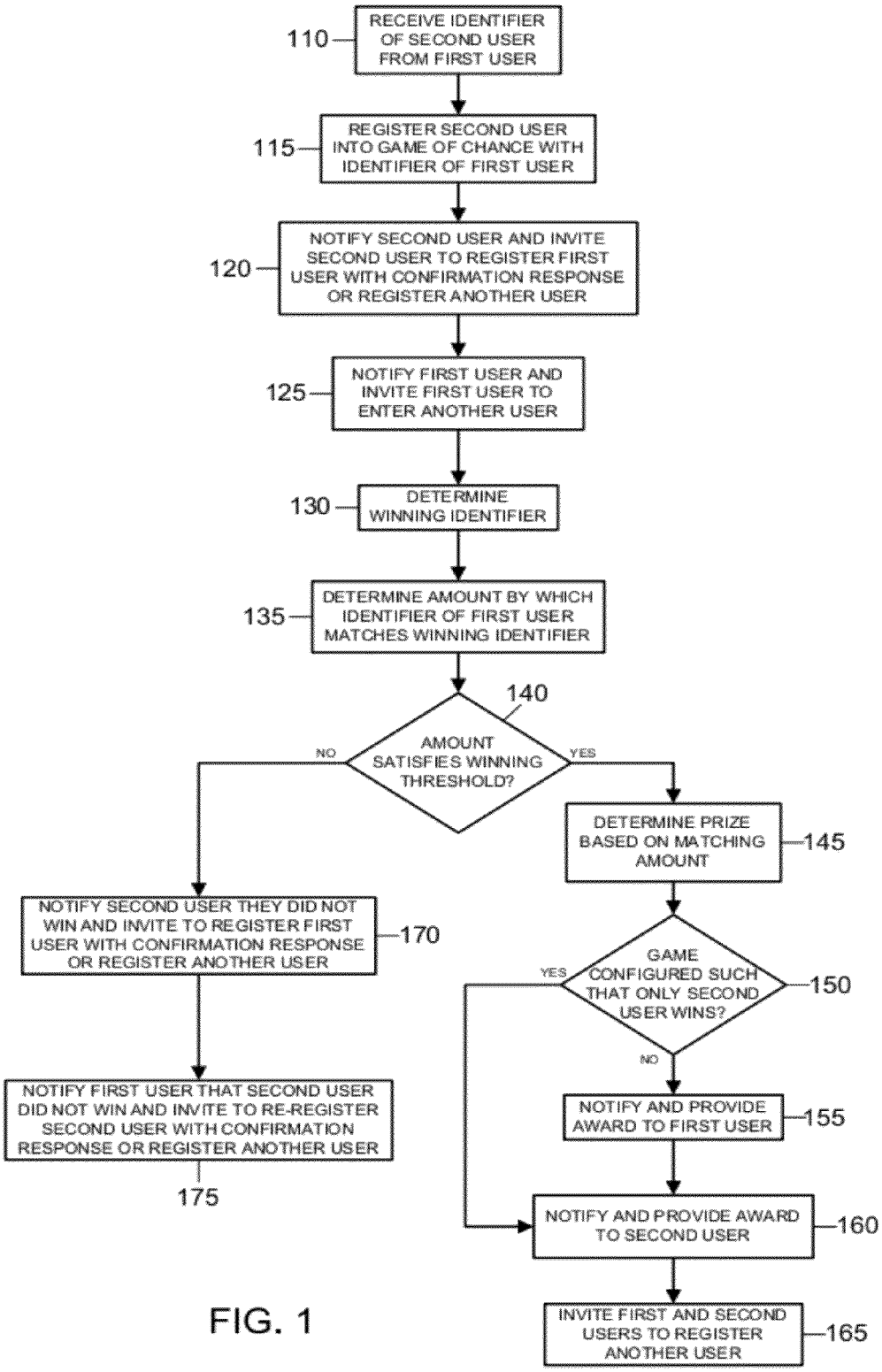
FIG. 1 is a flowchart illustrating the operations of a system for providing a game of chance over messaging services.

FIG. 1 is a flowchart illustrating the operations of a system for providing a game of chance over messaging services, such as short messaging services (SMS), multimedia messaging services (MMS), email, instant messaging, or generally any service capable of sending and receiving messages. At step 110, the system receives a message from a first user containing an identifier, such as an identifier of a second user. The message may be an email, a text message, an instant message, a postcard message, or generally any message capable of being communicated to the system. The first user may send the message to the system in order to register the second user into a game of chance provided by the system. For example, the system may send messages, such as mobile messages, to users inviting the users to register another user into a game of chance by responding to the message with an identifier of another user. In one example, the first user may send the message to the system in order to register both the first user and the second user into the game of chance provided by the system. The identifier may be a phone number, an address, or generally any data capable of identifying and/or contacting the second user.

For example, the system may receive a message, such as a short message service (SMS) message, also referred to as a text message, from the first user which contains the phone number of the second user. Upon receiving the message, the system may register the second user into the game of chance based on the identifier of the first user, such that if the identifier of the first user wins the game of chance, the second user wins a prize. In one example, upon receiving the message, the system may register the first user and the second user into the game of chance. In this example, if the first user may be registered into the game of chance based on the identifier of the first user and/or the second user, and the second user may be registered into the game of chance based on the identifier of the first user. The operator of the system may configure the game of chance such that a message from the first user registers only the second user, or a message from the first user registers the first user and the second user. The operator of the system may also charge the first user a fee upon receiving the message and registering the second user and/or the first user into the game of chance provided by the system. Alternatively, in the case of mobile messages, the mobile carrier of the mobile phone used by the first user may charge a fee to the mobile phone account of the first user for sending the message to the system. The fee may be in addition to any standard mobile messaging fees charged to the user for sending mobile messages. The mobile phone operator may pay some of the additional fee, or the entire additional fee, to the operator of the system providing the game of chance. Thus, in one example, the first user is charged a fee to only register the second user into the game of chance provided by the system, while the second user is not charged any fee. In another example, the first user is charged a fee to register both the first user and the second user into the game of chance provided by the system. The system may receive additional messages from users which contain identifiers of other users to be registered into the game of chance. The steps of registering users for the game of chance are discussed in more detail in FIG. 4 below.

At step 115, the system may register the second user into the game of chance with the identifier of the first user. For example, the system may store an association between the identifier of the first user and an identifier of the second user in a data store associated with the game of chance. At step 120, the system may notify the second user that the first user registered the second user into the game of chance, based on the identifier of the first user, and the system may invite the second user to enter the first user into the game of chance. For example, the system may send a message to the second user notifying the second user that the first user registered the second user into the game of chance based on the identifier of the first user. The message may invite the second user to return the favor by entering the first user into the game of chance. Since the first user paid a fee to enter the second user into the game of chance, the second user may feel socially obligated to pay a fee to enter the first user into the game of chance. The message may indicate a confirmation response the second user may respond with in order to enter the first user into the game of chance, such as the confirmation response "YES." In this instance, the second user may register the first user into the game of chance, based on the identifier of the second user, by responding to the invitation message with the response "YES." If the second user was entered into the game of chance multiple times, such as by multiple other users, each invitation message sent to the second user may include a unique confirmation response which the second user may respond with to register the user responsible for registering the second user. This may allow the system to identify the other user the second user wishes to register into the game of chance. For example, the confirmation response for the second user to register the first user may be "YES." However, if a third user also registers the second user into the game of chance, the confirmation response for the second user to register the third user into the game of chance may be "YES1," or some other string of characters which is different than the confirmation response for registering the first user. The system operating the game of chance may maintain a database which tracks the confirmation message associated with each user such that the system can identify the user the second user wishes to register into the game of chance based on a confirmation response. Alternatively, the second user may respond to the invitation with an identifier of another user, who would then be entered into the game of chance based on the identifier of the second user.

At step 125, the system may send a message to the first user which confirms that the second user was entered into the game of chance based on the identifier of the first user. The message may also include an invitation to the first user to enter another user into the game of chance. The first user may enter another user into the game of chance by responding to the confirmation message with an identifier of another user. By inviting both first user and the second user to register another user into the game of chance, the system creates a viral environment where each user who is registered into the game may register another user into the game of chance.

At step 130, the system may determine at least one winning identifier. For example, if the identifiers entered into the game of chance by the users are phone numbers, then the winning identifier may be a winning phone number. Alternatively, the system may determine multiple winning identifiers. The system may determine a winning identifier by randomly selecting at least one winning identifier from a set of identifiers. The set of identifiers may be the set of identifiers entered into the game by the users. Thus, if the winning identifier is selected from the set of identifiers entered into the game, then at least one identifier entered by a user should win the game of chance. Alternatively, if the identifiers are phone numbers, the set of identifiers may be a set of active phone numbers in the geographic location where the phone number of the second user originates from. In this case, there may be no winners if no users were registered into the game of chance with the winning phone number. Alternatively, the set of identifiers may be a set of active phone numbers which are associated with the same country code as the phone number of the second user. Generally the set of identifiers may be any set of identifiers which includes the identifiers entered into the game.

At step 135, the system may determine an amount by which the identifier of the first user matches the winning identifier. If the identifiers are phone numbers, the amount by which the phone numbers match may be based on the number of digits of the phone numbers that match. For example, if five digits of the phone number of the first user match the winning phone number, then the amount by which the phone number of the first user matches the winning phone number may be five. Alternatively, the amount by which the phone number of the first user matches the winning phone number may be the percent that the phone number of the first user matches the winning phone number. If the phone number of the first user has ten digits, and five of the digits match the winning phone number, then the amount by which the phone number entered by the second user matches the winning phone number would be fifty percent.

At step 140, the system determines if the amount by which the identifier of the first user matches the winning identifier satisfies the winning threshold. The winning threshold may identify the minimum amount by which the identifier of the first user must match the winning identifier in order to win the game. The operator may set the winning threshold based on the amount of prizes awarded for the game. For example, if there are a large number of prizes awarded, the winning threshold may be set lower, which would typically result in more winners of the game. However, if there are a small number of prizes awarded, the winning threshold may be set higher, which would typically result in less winners of the game. For example, if the amount by which the phone number of the first user matches the winning phone number is seven digits, and the winning threshold is at least six digits, then the amount by which the phone number of the first user matches the winning phone number would satisfy the threshold. Alternatively, the winning threshold may only be satisfied if the phone number of the first user is equivalent to the winning phone number. In the example where the system selects multiple winning identifiers, there may be a winning threshold for each winning identifier. In one example, the winning threshold for each winning identifier may only be satisfied by an exact, or complete, match of each winning identifier.

If, at step 140, the amount by which the identifier of the first user matches the winning identifier does not satisfy the winning threshold, the system moves to step 170. At step 170, the system may notify the second user, such as by sending a message to the second user, that they did not win a prize based on the identifier of the first user, and may invite the second user to register the first user, or another user, into the next game of chance. As mentioned above, the message may include a confirmation response which the second user may respond with to register the first user into the next game of chance, such as the confirmation response "YES." Alternatively, the second user may respond with the identifier of another user to enter another user into the game of chance.

At step 175, the system may notify the first user, such as by sending a message to the first user, that the second user did not win a prize based on the identifier of the first user, and may invite the first user to register the second user, or another user, into the next game of chance. As mentioned above, the message may include a confirmation response which the first user may respond with to register the second user into the next game of chance, such as the confirmation response "YES." Alternatively, the first user may respond with the identifier of another user to enter another user into the game of chance.

If, at step 140, the amount by which the identifier of the first user matches the winning identifier satisfies the threshold, the system moves to step 160. At step 145, the system determines the prize awarded to the second user. For example, the prize awarded may be based on the amount by which the identifier of the first user matches the winning identifier. In this example, the prize may increase as the amount by which the identifier of the first user matches the winning identifier increases. Alternatively, the prizes may be arranged in tiers. For example, in the case of phone numbers, a phone number which matches all of the digits of the winning phone number would receive the largest prize, a phone number that matches all but one of the digits would receive a smaller prize, and so on. Alternatively, the system may select multiple winning identifiers. In this case, each winning identifier may be associated with a different prize amount. The prize amount may increase, or may decrease, with each successively selected winning identifier. In one example, the system may only award the prize associated with each winning identifier if an identifier registered into the game exactly matches one of the winning identifiers.

At step 150, the system determines whether the game is configured such that only the second user wins a prize for the identifier of the first user winning, or if both the first user and the second user win a prize for the identifier of the first user winning. For example, as mentioned above, the game of chance may be configured such that a message sent by the first user registers both the first user and the second user into the game of chance, or the game of chance may be configured such that the message sent by the first user only registers the second user into the game of chance. If the game of chance is configured such that the message only registers the second user in the game of chance, the system moves to step 160. If the game of chance is configured such that the first user and the second user are registered into the game of chance, the system moves to step 155.

At step 155, the system notifies the first user, such as by sending a message to the first user, that the first user won a prize because the identifier of the first user matches the winning identifier. The system may also provide the prize, or award, to the first user. For example, the system may send an electronic payment in the amount of the prize determined in step 145 to the first user. Alternatively, the system may credit an account of the first user, such as the mobile phone account of the first user, with the prize amount.

At step 160, the system notifies the second user, such as by sending a message to the second user, that the second user won a prize because the identifier of the first user matches the winning identifier. The system may also provide the prize, or award, to the second user. For example, the system may send an electronic payment in the amount of the prize determined in step 145 to the second user. Alternatively, the system may credit an account of the second user, such as the mobile phone account of the second user, with the prize amount.

At step 165, the system may invite the first and second users to register another user into the next game of chance. The system may send a message to the first user inviting the first user to register the second user, or another user, into the next game of chance. As mentioned above, the message may include a confirmation response which the first user may respond with to register the second user into the next game of chance, such as the confirmation response "YES." Alternatively, the first user may respond with the identifier of another user to enter another user into the next game of chance. The system may also send a message to the second user inviting the second user to register the first user into the next game of chance. As mentioned above, the message may include a confirmation response which the second user may respond with to register the first user into the next game of chance, such as the confirmation response "YES." Alternatively, the second user may respond with the identifier of another user to enter another user into the next game of chance.

Figure 2:
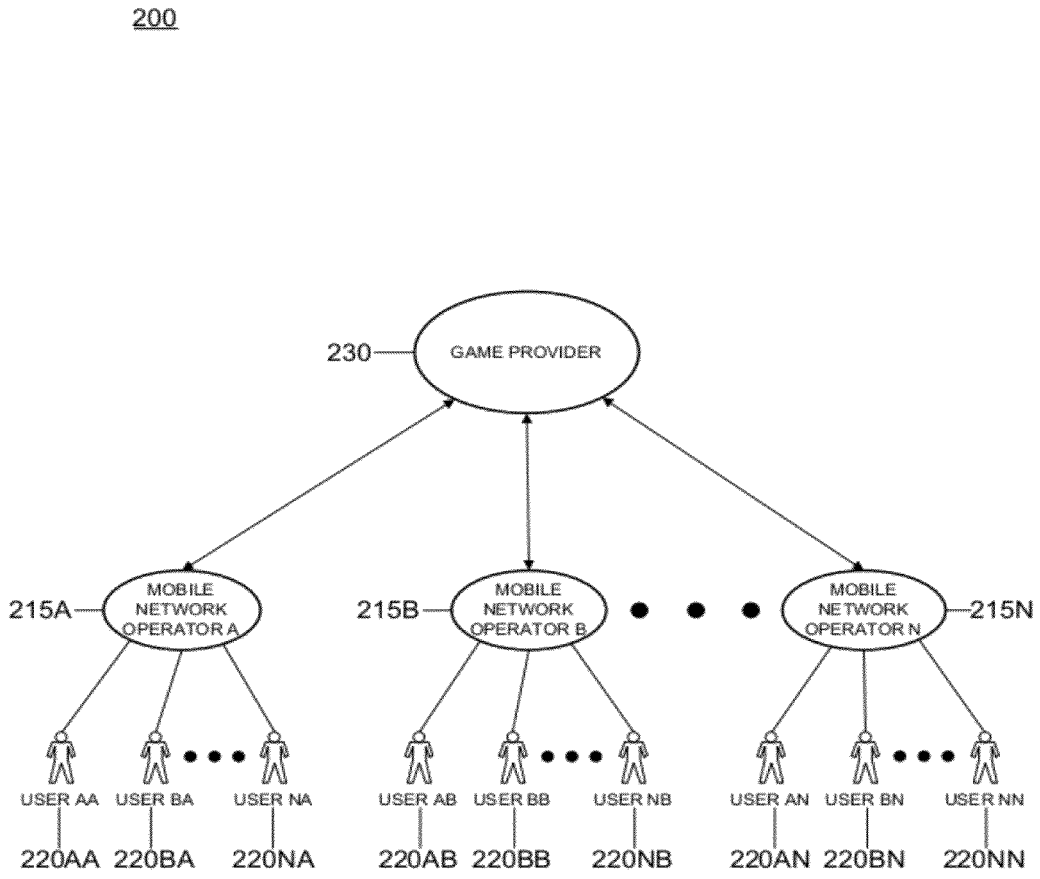
FIG. 2 is a block diagram of a general overview of a system for providing a game of chance over messaging services.

FIG. 2 provides a general overview of a system 200 for providing a game of chance over messaging services. Not all of the depicted components may be required, however, and some implementations may include additional components. Variations in the arrangement and type of the components may be made without departing from the spirit or scope of the claims as set forth herein. Additional, different or fewer components may be provided.

The system 200 may include a game provider 230, one or more mobile network operators ("MNOs") 215A-N, more commonly referred to as mobile carriers, or simply carriers, and one or more users 220AA-NN, such as mobile subscribers or consumers. The game provider 230 may provide games to the mobile users 220AA-NN, such as games of chance.

The users 220AA-NN may pay a fee to the game provider 230 to participate in the games provided by the game provider 230, such as games of chance played over mobile messaging, or generally any games capable of being provided over mobile devices. Alternatively, the user 220AA-NN may pay a fee to the MNOS 215A-N to participate in the games provided by the game provider 230, and the MNOs 215A-N may pay all or part of the fees to the game provider 230. The game provider 230 may provide the games to the mobile users 220AA-NN over the mobile web, mobile messaging, mobile applications, such as an Apple iPhone™ mobile application, an interactive voice response system, or generally any medium for communicating with users of mobile devices. In addition, the game provider 230 may maintain a web portal, which may allow the mobile users 220AA-NN to access the games provided by the game provider 230 over the internet. The game provider 230 may also allow the mobile users 220AA-NN to access the games through the postal service. For example, a mobile user 220AA-NN may send a postcard to the game provider 230 to participate in a game of chance.

The game provider 230 may maintain a mobile portal and/or a web portal where the game provider 230 may display information related to the games provided by the game provider 230. For example, the portal may display the games currently available to the users 220AA-NN, the results of previous games provided to the users 220AA-NN, entry forms for games provided by the game provider 230, rules of games provided by the game provider 230, or generally any information related to the games provided by the game provider 230. In the case of games provided to the mobile users 220AA-NN, the game provider 230 may share revenue with the MNOs 215A-N of the users 220AA-NN for providing the games to the users 220AA-NN, such as by providing the games over mobile messages sent through the mobile infrastructure of the MNOs 215A-N. The revenue may be collected from the users 220AA-NN by the game provider and/or the revenue may be collected from the users 220AA-NN by the MNOs 215A-N.

The MNOs 215A-N may provide a mobile network to the users 220AA-NN which may provide a variety of services to the users 220AA-NN, such as the ability to send and receive phone calls, send and receive mobile messages, to access the internet and/or the mobile web, or generally any service that may be implemented on a mobile device. The MNOs 215A-N may store data describing the users 220AA-NN, such as billing addresses, call histories, messaging histories, or generally any data regarding the users 220AA-NN that may be available to the MNOs 215A-N.

The game provider 230 may provide an application programming interface ("API") to the MNOs 215A-N to allow the MNOs 215A-N to access the mobile services of the game provider 230, such as mobile games. The MNOs 215A-N may provide the mobile games of the game provider 230 to the users 220AA-NN. The mobile games may be provided transparently to the mobile users 220AA-NN such that the users 220AA-NN are unaware that the mobile games originated from the game provider 230.

The users 220AA-NN may be mobile users who may engage in messaging with one another, such as through a short message service ("SMS"), a multimedia messaging service ("MMS"), enhanced messaging service ("EMS"), J-PHONE's Skymail, NTT DOCOMO'S Short Mail, or generally any service for sending messages to/from mobile devices. The mobile messages may be routed through the MNOs 215A-N. The users 220AA-NN may wish to participate in games over the mobile messaging services. For example, the mobile devices of the users 220AA-NN may be technologically limited such that the devices are not capable of playing graphically intensive games, or games which require high bandwidth. Thus, the users 220AA-NN may only be able to participate in games provided over mobile messaging services or other low-bandwidth services.

The users 220AA-NN may interact individually with the game provider 230, through the mobile network operators 215A-N, such as via a mobile phone or any mobile device capable of communicating with the mobile network operators 215A-N. The users 220AA-NN may interact with the game provider 230 via a mobile web based application, a mobile standalone application, a mobile messaging application, or any application capable of running on a mobile device. The game provider 230 may communicate mobile messages to the users 220AA-NN over the mobile infrastructure provided by the MNOs 215A-N.

The game provider 230 may send mobile messages to the users 220AA-NN notifying the users 220AA-NN of currently available games. For example, the game provider 230 may notify the users 220AA-NN of an open registration for a game of chance over mobile messaging. The users 220AA-NN may respond to the mobile message with the identifier of another user to participate in the game of chance. In one example, a first user 220AA may respond with a mobile message containing an identifier of a second user 220BB, such as the mobile phone number of the second user 220BB. The game provider 230 may send a mobile message to the second user 220BB informing the second user 220BB that they have been registered for the game of chance. The message may notify the second user 220BB that they may participate in the game of chance by responding to the mobile message. The game provider 230 may configure the game such that if the mobile number of the second user 220BB wins the game of chance, only the second user 220BB is rewarded with a prize. Alternatively, the game provider 230 may configure the game of chance such that if the mobile number of the second user 220BB wins the game of chance, both the first user and the second user are rewarded with a prize.

Figure 3:
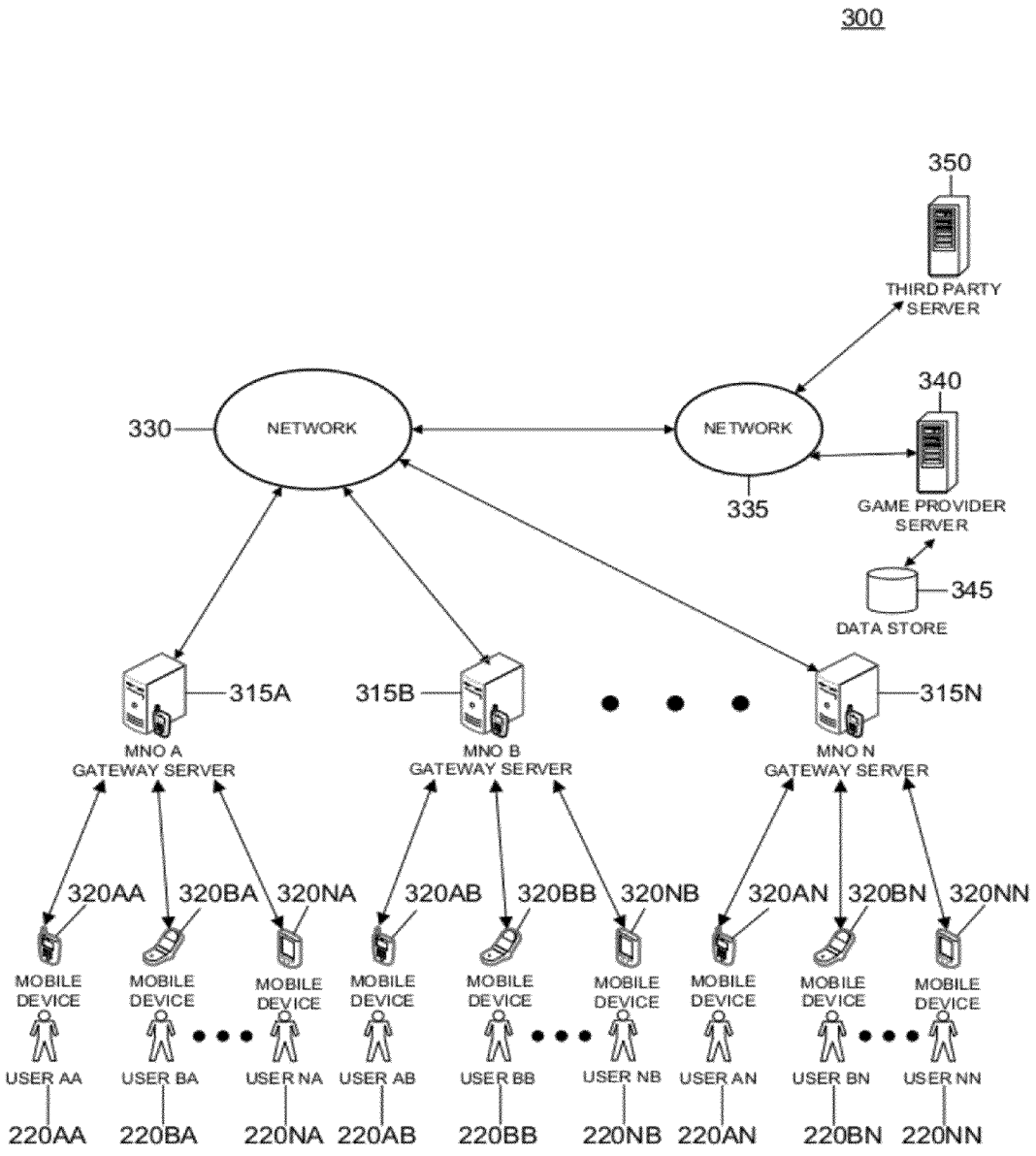
FIG. 3 is block diagram of a simplified view of a network environment implementing the system of FIG. 2 or other systems for providing game of chance over mobile messaging.

FIG. 3 provides a simplified view of a network environment implementing a system 300 for providing a game of chance over messaging services. Not all of the depicted components may be required, however, and some implementations may include additional components not shown in the figure. Variations in the arrangement and type of the components may be made without departing from the spirit or scope of the claims as set forth herein. Additional, different or fewer components may be provided.

The system 300 may include one or more mobile applications, such as mobile messaging applications and/or mobile browsers, which may be running on one or more mobile devices 320AA-NN. The system 300 may also include one or more MNO gateway servers 315A-N, a network 330, a network 335, the game provider server 340, a data store 345, and a third party server 350.

Some or all of the game provider server 340 and third party server 350 may be in communication with each other by way of network 335 and may be the system or components described below in FIG. 9. The game provider server 340 and third-party server 350 may each represent multiple linked computing devices. Multiple distinct third party servers, such as the third-party server 350, may be included in the system 300. The third-party server 350 may be an MNO gateway server 315A-N or a server associated with, or in communication with an MNO gateway server 315A-N. Alternatively, the third party server 350 may be a data source capable of providing all of the active phone numbers in a given geographic region, such as a country.

The networks 330, 335 may include wide area networks ("WAN"), such as the internet, mobile networks, local area networks ("LAN"), campus area networks, metropolitan area networks, or any other networks that may allow for data communication. The network 330 may include the Internet and may include all or part of network 335; network 335 may include all or part of network 330. The networks 330, 335 may be divided into sub-networks. The sub-networks may allow access to all of the other components connected to the networks 330, 335 in the system 300, or the sub-networks may restrict access between the components connected to the networks 330, 335. The network 335 may be regarded as a public or private network connection and may include, for example, a virtual private network or an encryption or other security mechanism employed over the public Internet, or the like.

The users 220AA-NN may use a mobile application running on a mobile device 320AA-NN, such as a mobile web browser, to communicate with the game provider server 340, via the MNO gateway servers 315A-N and the networks 330, 335. The game provider server 340 may communicate to the users 320AA-NN via the networks 330, 335 and the MNO gateway servers 315A-N, through the mobile devices 320AA-NN.

The web applications, standalone applications, mobile applications and mobile devices 320AA-NN may be connected to the network 330 in any configuration that supports data transfer. This may include a data connection to the network 330 that may be wired or wireless. The mobile devices 320AA-NN may be one of a broad range of electronic devices which may include mobile phones, PDAs, and laptops and notebook computers. The mobile devices 320AA-NN may have a reduced feature set, such as a smaller keyboard and/or screen, however the mobile devices 320AA-NN may be capable of supporting mobile messaging.

The data connection of the mobile devices 320AA-NN may be a cellular connection, such as a GSM/GPRS/WCDMA connection, a wireless data connection, an internet connection, an infra-red connection, a Bluetooth connection, or any other connection capable of transmitting data. The data connection may be used to connect directly to the network 330, or to connect to the network 330 through the MNO gateway servers 315A-N.

The MNOs 215A-N may utilize various components to provide these services to the users 220AA-NN, such as network switching systems ("NSS"), mobile switching centers ("MSC"), mobile switching center servers ("MSC-S"), home location registers ("HLR"), authentication centers ("AUC"), short message service centers ("SMSC"), signal transfer points ("STP"), message service centers ("MSC"), or generally any component that may be utilized to provide the mobile services. The MNOs 215A-N may interface with one or more external short messaging entities ("ESME"), such as the third party server 350, which may connect to the MNOs 215A-N to send and/or receive mobile messages to the users 220AA-NN. The ESMEs may provide voicemail, web, email, or other services to the users 220AA-NN of the MNOs 215A-N.

The game provider server 340 may include one or more of the following: an application server, a data source, such as a database server, a middleware server, and an advertising services server. The game provider server 340 may co-exist on one machine or may be running in a distributed configuration on one or more machines The game provider server 340 may collectively be referred to as the server. The game provider server 340 may receive mobile messages from the users 220AA-NN and may send mobile messages to the users 220AA-NN.

The data store 345 may be part of the service provider server 340 and may be a database server, such as MICROSOFT SQL SERVER®, ORACLE®, IBM DB2®, SQLITE®, or any other database software, relational or otherwise. The data store 345 may store all data items pertaining to the games of chance, including data describing each registration into the game of chance. For example, in the case of a game of chance where a user A 120A registers user B 120B by sending a message containing the phone number of the user B 12B, the data store 345, may store an association between the phone number of the registered user B 120B, the phone number of the user A 120A who registered the registered user B 120B, and an identifier of the game of chance the registered user B 120B was registered for, such as a unique number. The association may also include the response message the user B 120B may respond with to register the user A 120A in the game of chance, such as the response message "YES." Thus, if the user B 120B was entered into the game of chance multiple times by different users, the data store 345 may store an association for each entry of the user B 120B into the game of chance. Thus, for each registration into a game of chance, the data store 345 may store an association between the identifier of the registered user, the identifier of the registering user (the user who registered the registered user), the identifier of the game the registered user was registered for, and the confirmation response associated with the registering user.

The third party server 350 may include one or more of the following: an application server, a data source, such as a database server, a middleware server, and an advertising services server. The third party server 350 may co-exist on one machine or may be running in a distributed configuration on one or more machines Alternatively or in addition, the third party server may be an ESME server.

Figure 9:
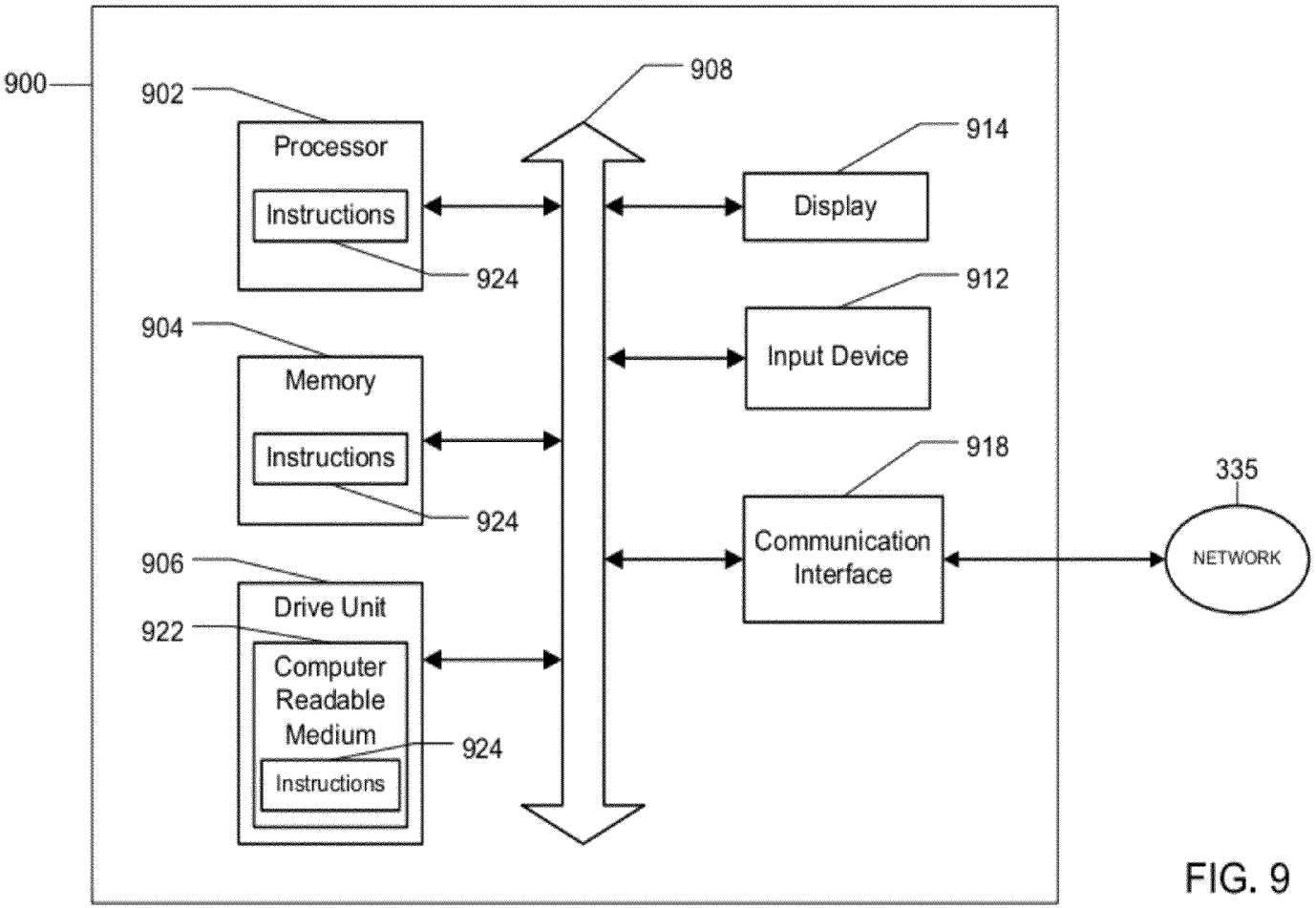
FIG. 9 is an illustration a general computer system used in the system of FIG. 2, or other systems for providing a game of chance over messaging services.

The game provider server 340, the third party server 350, the MNO gateway servers 315A-N, and the mobile devices 320AA-NN may be one or more computing devices of various kinds, such as the computing device in FIG. 9. Such computing devices may generally include any device that may be configured to perform computation and that may be capable of sending and receiving data communications by way of one or more wired and/or wireless communication interfaces. Such devices may be configured to communicate in accordance with any of a variety of network protocols, including but not limited to mobile messaging protocols.

Figure 4:
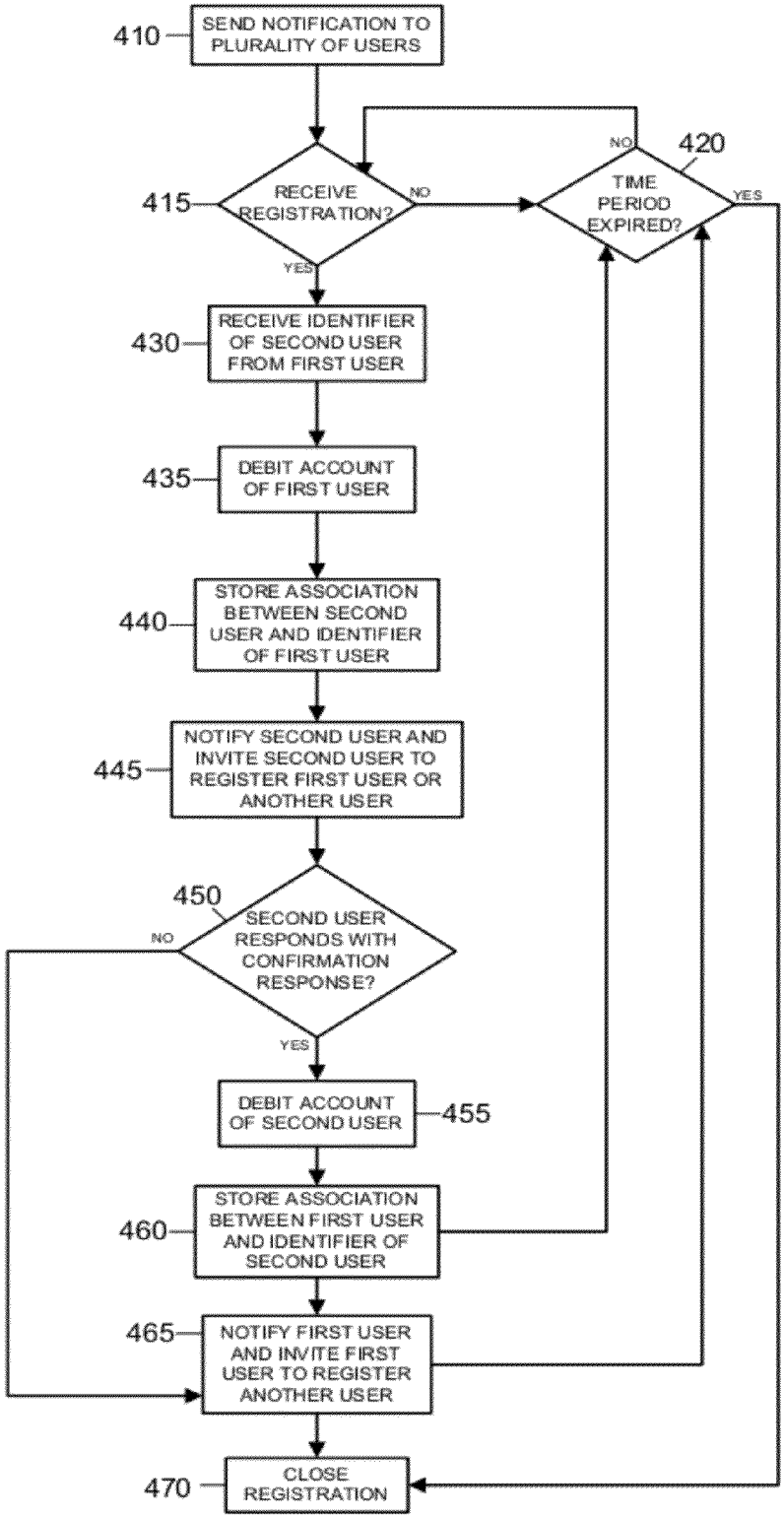
FIG. 4 is a flowchart illustrating a registration operation of the system of FIG. 2 or other systems for providing a game of chance over messaging services.

FIG. 4 is a flowchart illustrating a registration operation of the system of FIG. 2, or other systems for providing a game of chance over messaging services. At step 410, the system 200 sends a notification to the users 220AA-NN inviting the users to register another user into a game of chance by providing an identifier of another user. The notification may indicate whether the game is configured such that users 220AA-NN can only register another user into the game of chance, or if the users 220AA-NN can register themselves and/or another user into the game of chance. For example, the notification may be a mobile message sent to the users 220AA-NN through the MNOs 215A-N. The notification may also include the amount of time left for the users 220AA-NN to register for the game. The registration period for each game may only last for a period of time, such as a day. After the registration period expires, the users 220AA-NN may no longer be allowed to participate in that particular game. However, the user may be automatically entered into the next game.

At step 415, the system 200 waits for one of the users 220AA-NN to register another user into the game of chance. The users 120A-n may register another user by sending a message to the system 200 with the identifier of the other user. Alternatively, if one of the user A 120A was registered into the game of chance by the user B 120B, the user A 120B may register the user A 120A into the game of chance by sending the confirmation response associated with the user A 120A to the system 200. If, at step 415, the system 200 does not receive a response from one of the users 220AA-NN, the system 200 moves to step 420. At step 420, the system 200 checks to determine if the registration period has expired. If, at step 420, the system 200 determines that the registration period has not expired, the system 200 returns to step 415 and waits for a response from one of the users 220AA-NN.

If, at step 415, the system 200 receives a response from one of the users 220AA-NN, the system 200 moves to step 430. At step 430, the system 200 receives an identifier of a second user from a first user. For example, a first user may send a mobile message to the system 200 which contains an identifier of the second user, such as a phone number of the second user. At step 435, the system 200 may debit an account of the first user. The account of the first user may be debited by the game provider server 340, or may be debited by one of the MNOs 215A-N. For example, the MNO which provided mobile service to the first user may charge the mobile account of the first user a fee for sending the mobile message to the system 200, the fee being in addition to any regularly charged text message fees.

At step 440, the system 200 stores an association between an identifier of the second user, the identifier of the first user, and an identifier of the game of chance in a data store or memory. The association may also include the confirmation response associated with the first user. At step 445, the system 200 may send a registration notification to the second user, such as through a mobile message. The registration notification may notify the second user that the first user registered the second user for the game of chance. The message may invite the second user to return the favor by entering the first user into the game of chance. Since the first user paid a fee to enter the second user into the game of chance, the second user may feel socially obligated to pay a fee to enter the first user into the game of chance. The message may indicate a confirmation response the second user may respond with in order to enter the first user into the game of chance, such as the confirmation response "YES." In this instance, the second user may register the first user into the game of chance, based on the identifier of the second user, by responding to the invitation message with the response "YES." Alternatively, the second user may respond to the invitation with an identifier of another user, who would then be entered into the game of chance based on the identifier of the second user.

At step 450, the system 200 determines whether the second user responded with the confirmation response, such as "YES." If, as step 450, the system 200 determines that the second user responded with the confirmation response, the system 200 moves to step 455. At step 455, the system 200 debits an account of the second user. The account of the second user may be debited by the game provider server 340, or may be debited by one of the MNOs 215A-N. For example, the MNO which provided mobile service to the second user may charge the mobile account of the second user a fee for sending the mobile message to the system 200, the fee being in addition to any regularly charged text message fees.

If, at step 450, the second user did not respond with the confirmation response the system 200 moves to step 465. The second user may still respond with the confirmation response anytime prior the expiration of the registration period. At step 460, the system 200 stores an association between an identifier of the first user, an identifier of the second user, and an identifier of the game of chance in the data store 345 or in memory. The association may also include a confirmation response associated with the second user. At step 465, the system 200 may notify the first user that the second user was successfully registered into the game of chance, and may invite the first user to enter the identifier of another user into the game of chance. If the second user responded with the confirmation response for the first user, thereby registering the first user into the game of chance, the message may invite the first user to register the second user into the game of chance again. The message may indicate a confirmation response the first user may respond with in order to register the second user into the game of chance again, such as the confirmation response "YES."

After sending the notification to the first user at step 465, the system 200 returns to step 420 and determines whether the registration period has expired. Once the registration period expires, the system 200 moves to step 470. At step 470, the registration for the game of chance is closed. Alternatively, when the registration for the game of chance closes, a registration for another game of chance may immediately open. Thus, if a user enters an identifier into the game of chance after the registration time period expires, the user may be automatically entered into the next game of chance.

Figure 5:
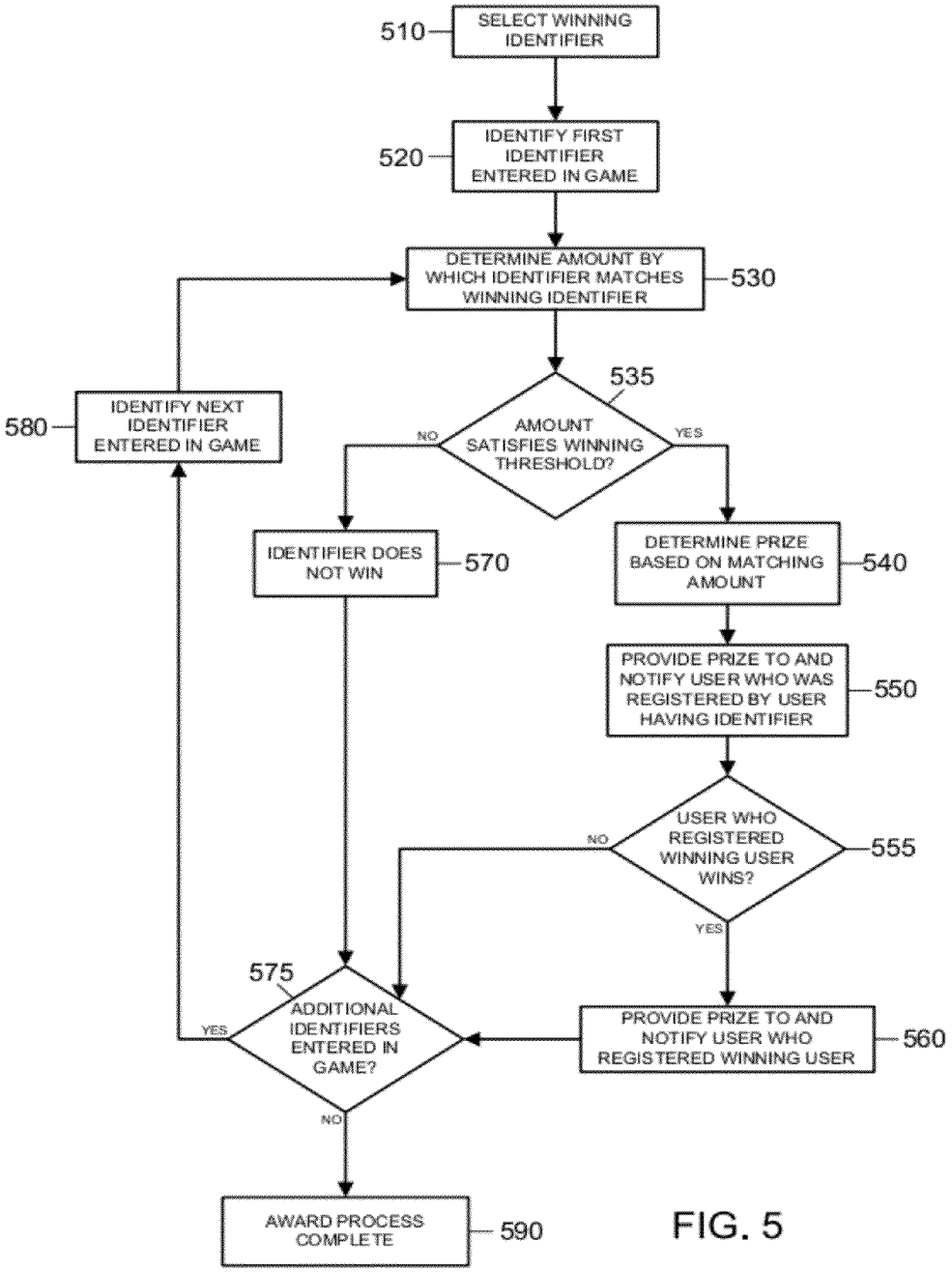
FIG. 5 is a flowchart illustrating a game-play operation of the system of FIG. 2 or other systems for providing a game of chance over messaging services.

FIG. 5 is a flowchart illustrating a game-play operation of the system of FIG. 2 or other systems for providing a game of chance over messaging services. At step 510, the system 200 selects a winning identifier from a set of identifiers. As previously mentioned, the set of identifiers may be the set of identifiers entered into the game of chance, a set of identifiers which exist in a geographic region, or generally any set of identifiers which includes the identifiers entered into the game of chance.

At step 520, the system 200 retrieves the first identifier entered into the game of chance. For example, the system 200 may retrieve the first identifier stored in a database or from memory. At step 530, the system determines the amount by which the identifier matches the winning identifier. The amount may be a percentage of the identifier which matches the winning identifier, or a number of characters and/or numbers of the identifier which match the winning identifier. One game of chance may require that the characters and/or numbers of the identifier match the winning identifier in order. However, other games may not require that the characters and/or numbers of the identifier match the winning identifier in order.

At step 535, the system 200 determines whether the determined amount by which the identifier matches the winning identifier satisfies the winning threshold. The winning threshold may be different for each game depending upon the amount of winners the operator would like each game to have. The lower the winning threshold is, the more winners there will likely be, and vice-versa. Thus, the winning threshold may vary depending upon the number of identifiers entered into the game, the fee for entering the game, and the size of the prizes awarded for each amount by which each identifier matches the winning identifier. In one example, the winning threshold may only be satisfied if the identifier is an exact match of the winning identifier. If, at step 535, the system 200 determines that the amount by which the identifier matches the winning identifier satisfies the winning threshold, the system 200 moves to step 540.

At step 540, the system 200 determines the prize for the identifier based on the amount by which the identifier matches the winning identifier. For example, the prize may increase as the amount by which the identifier of the second user matches the winning identifier increases. The prizes may be arranged in tiers. For example, in the case of phone numbers, a phone number which matches all of the digits of the winning phone number would receive the largest prize, a phone number that matches all but one of the digits would receive a smaller prize, etc. If the winning threshold is only satisfied if the identifier is an exact match of the winning identifier, then there may only be one winning identifier. In this case the prize may be based on the number of entries into the game, or may be determined prior to the start of the game. Alternatively, the system 200 may select multiple winning identifiers. In this case, each winning identifier may be associated with a different prize amount. The prize amount may decrease, or increase, for each successively selected winning identifier.

At step 550, the system 200 may notify the user who was registered by the user having the identifier that the user wins a prize. For example, if a first user registers a second user for the game of chance with the identifier of the first user, and the identifier of the first user is a winning identifier, then the second user wins a prize. The system 200 may send a mobile message to the winning user informing the user that they won a prize and inviting the user to participate in the next game of chance by responding to the mobile message with an identifier of another user. The system 200 may also provide the prize to the winning user. For example, the system 200 may send an electronic payment in the amount of the prize determined in step 540 to the winning user.

At step 555, the system 200 may determine whether the game was configured such that both the user who was registered by the user having the winning identifier wins a prize, and the user having the winning identifier wins a prize. If, a step 555, the system 200 determines that the game was configured such that both the user who was registered by the user having the winning identifier wins a prize and the user having the winning identifier wins a prize, the system 200 moves to step 560. At step 560, the system 200 notifies the user who registered the winning user that the user wins a prize because their identifier satisfies the winning threshold. For example, the system 200 may sent a mobile message to the user informing the user that they won a prize and inviting the user to participate in another game by responding to the mobile message with an identifier of another user. The system 200 may also provide the prize to the user who registered the winning user. For example, the system 200 may send an electronic payment in the amount of the prize determined in step 540 to the user who registered the winning user. If, at step 560, the system 200 determines that the game was configured such that only the user who was registered by the user having the winning identifier wins a prize, the system moves to 575.

If, at step 535, the system 200 determines that the amount by which the identifier matches the winning identifier does not satisfy the winning threshold, then the system 200 moves to step 570. At step 570, the system determines that the identifier does not win, and thus, the user who was registered by the user having the identifier does not win a prize. The system 200 may send a mobile message to the user who was registered by the user having the identifier, and the user having the identifier, to inform them that the registered user did not win the game of chance. The mobile message may invite the users to play in the next game of chance by responding to the mobile message with an identifier of another user. At step 575, the system 200 determines whether there are additional identifiers which were entered into the game. If, at step 575, the system 200 determines that there are additional identifiers entered into the game, the system 200 moves to step 580. At step 580, the system 200 identifies the next identifier entered into the game and repeats steps 530-575 for the next identifier.

If, at step 575, the system 200 determines that there are no additional identifiers entered into the game, then the system 200 moves to step 590. At step 590, the award process is complete and the system 200 may send out mobile messages to the users 220AA-NN informing the users 220AA-NN of the next game of chance.

Figure 6:
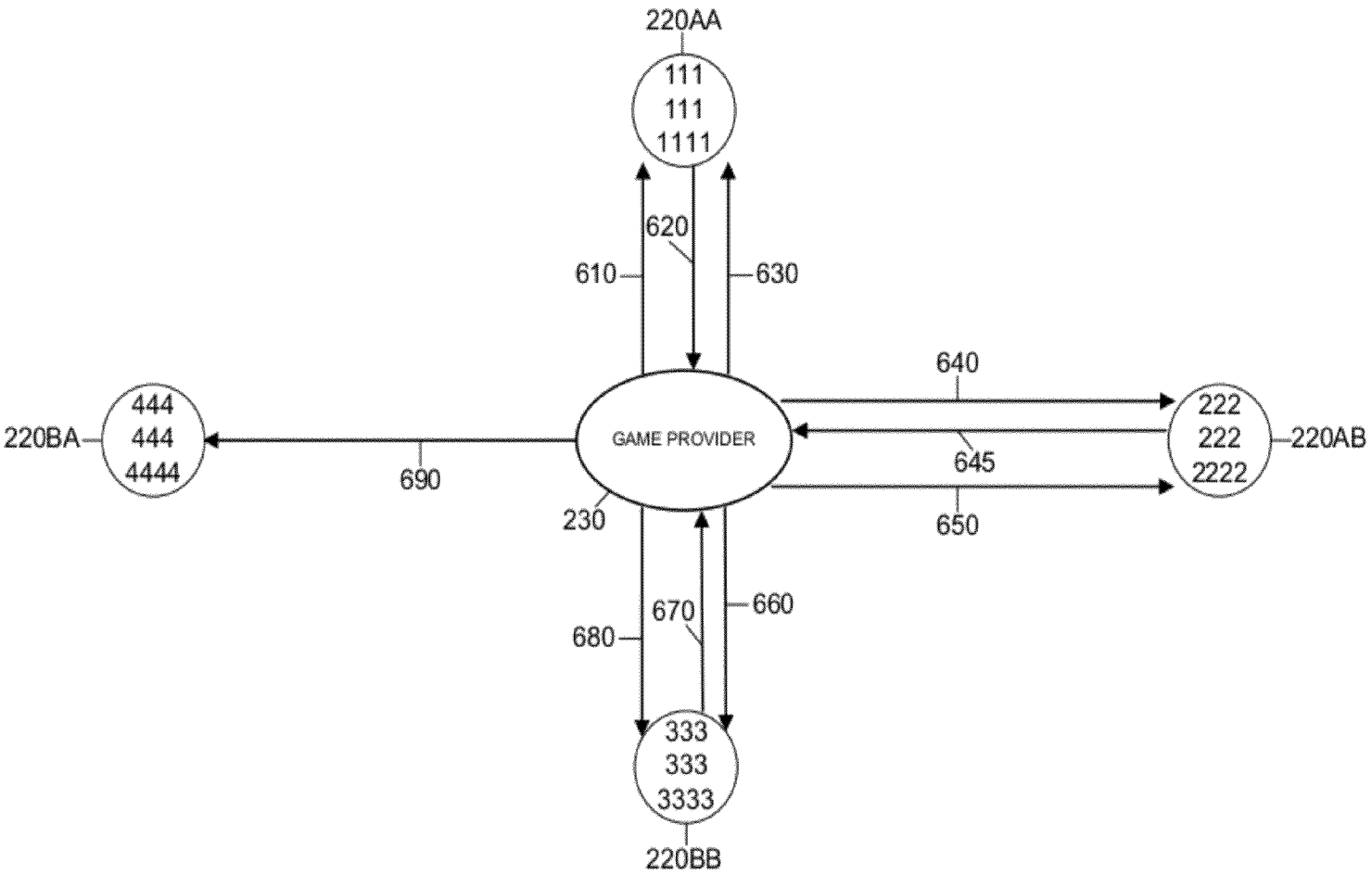
FIG. 6 is an illustration demonstrating a user case in the system of FIG. 2 or other systems for providing a game of chance over messaging services.

FIG. 6 is a diagram demonstrating an exemplary use case of the system of FIG. 2 or other systems for providing a game of chance over messaging services.

In FIG. 6, the user 220AA has the phone number "111-111-1111," the user 220AB has the phone number "222-222-2222," the user 220BB has the phone number "333-333-3333," and the user 220BA has the phone number "444-444-4444." At step 610, the game provider 230 sends a mobile message to the mobile device 320AA of the mobile user 220AA. The mobile message informs the user 220AA that registration is open for a game of chance and invites the user 220AA to register another user for the game of chance by providing a mobile phone number of another user. The mobile message may further indicate whether a submission of a phone number by the user 220AA into the game of chance registers only the user having the phone number into the game of chance, or registers both the user 220AA and the user having the phone number into the game of chance, depending upon the configuration of the game. At step 620, the user 220AA sends a mobile message to the game provider 230 to register another user in the game of chance. The mobile message includes the phone number "222-222-2222" of the user 220AB. At step 630, the game provider 230 sends a mobile message to the user 220AA confirming that the user 220AA has registered the user 220AB having the phone number "222-222-2222" into the game of chance. The mobile message may indicate whether the entry registers both the user 220AA into the game of chance and the user 220AB into the game of chance, or only registers the user 220AB into the game of chance. The mobile message may also invite the user 220AA to participate in the game of chance again by replying to the mobile message with a phone number.

At step 640, the game provider 230 sends a mobile message to the user 220AB to inform the user 220AB that the phone number of the user 220AB was submitted to the game of chance by the user 220AA, thereby registering the user 220AB into the game of chance with the phone number of the user 220AA. The mobile message may also invite the user 220AB to participate in the game of chance by replying to the mobile message with a phone number, or replying with a confirmation response, such as "YES", which will register the user 220AA into the game of chance. The mobile message may further indicate whether a submission of a phone number by the user 220AB into the game of chance registers only the user having the phone number into the game of chance, or registers both the user 220AB and the user having the phone number into the game of chance. At step 645, the user 220AB replies to the mobile message of the game provider 230 with the phone number "333-333-3333" of the user 220BB. At step 650, the game provider 230 sends a mobile message to the user 220AB confirming that the user 220AB registered the user 220BB having the phone number "333-333-3333" into the game of chance. The mobile message may indicate whether the entry registered both the user 220AB into the game of chance and the user 220BB into the game of chance, or only registered the user 220BB into the game of chance. The mobile message may also invite the user 220AB to participate again in the game of chance by replying to the mobile message with a phone number.

At step 660, the game provider 230 sends a mobile message to the user 220BB to inform the user 220BB that the phone number of the user 220BB was submitted to the game of chance by the user 220AB, thereby registering the user 220BB into the game of chance with the phone number of the user 220AB. The mobile message may also invite the user 220BB to participate in the game of chance by replying to the mobile message with a phone number, or replying with a confirmation response, such as "YES", which will register the user 220AA into the game of chance. The mobile message may further indicate whether a submission of a phone number by the user 220BB into the game of chance registers only the user having the phone number into the game of chance, or registers both the user 220BB and the user having the phone number into the game of chance. At step 670, the user 220BB replies to the mobile message from the game provider 230 with the phone number "444-444-4444" of the user 220BA. At step 680, the game provider 230 sends a mobile message to the user 220BB confirming that the user 220BB registered the user 220BA having the phone number "444-444-4444" into the game of chance. The mobile message may indicate whether the entry registered both the user 220BB and the user 220BA into the game of chance, or only registered the user 220BA into the game of chance. The mobile message may also invite the user 220AA to participate in the game of chance again by replying to the mobile message with a phone number.

At step 690, the game provider 230 sends a mobile message to the user 220BA to inform the user 220BA that the phone number of the user 220BA was submitted to the game of chance by the user 220BB, thereby registering the user 220BA into the game of chance with the phone number of the user 220BB. The mobile message may also invite the user 220BA to participate in the game of chance by replying to the mobile message with a phone number, or replying with a confirmation response, such as "YES", which will register the user 220AA into the game of chance. The steps of the use case may demonstrate how the game of chance can rapidly proliferate from user to user.

Figure 7:
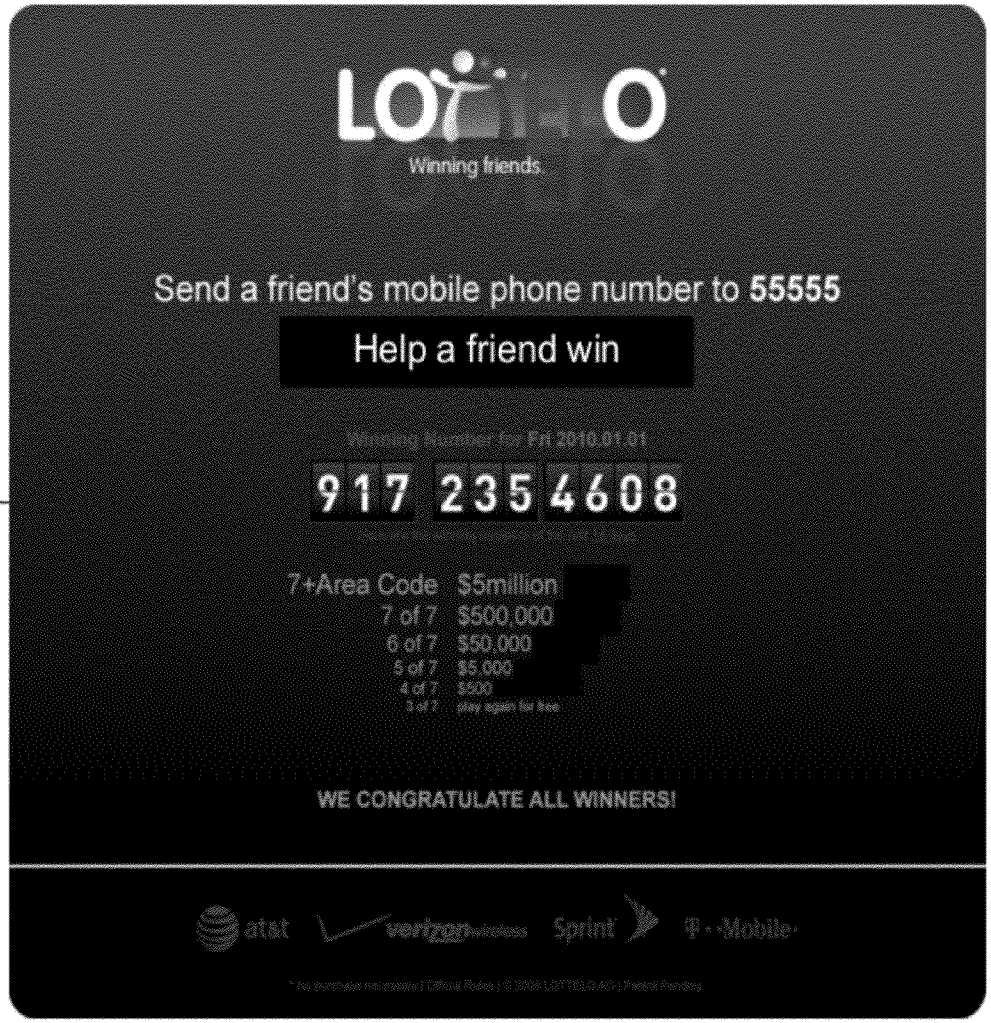
FIG. 7 is a screenshot of a web page related to a game provided by the system of FIG. 2 or other systems for providing a game of chance over mobile devices.

FIG. 7 is a screenshot of a web page 700 related to a game provided by the system of FIG. 2 or other systems for providing a game of chance over messaging services. The web page 700 may be representative of a game of chance configured such that if a phone number wins the game of chance, only the user who was registered into the game of chance with the phone number wins a prize. The web page 700 may include the phone number the users 120A-N send messages to in order to participate in the game of chance. For example, a user A 120A may participate in the game by sending a mobile message to the phone number. The web page 700 may also include the winning phone number for a particular date, such as 2010.01.01. The web page 700 may also include the amount of the prize won by the user who was registered by the user having the winning phone number. The web page 700 demonstrates that the prize may vary depending upon the amount that a phone number matches the winning phone number.

Alternatively, the web page 700 may list several winning numbers. Each winning number may be associated with a different prize. The prizes may vary in amount from winning number to winning number. For example, the winning number listed at the top of the web page 700 may have the highest prize amount and the winning number listed at the bottom of the web page 700 may have the lowest prize amount.

Figure 8:
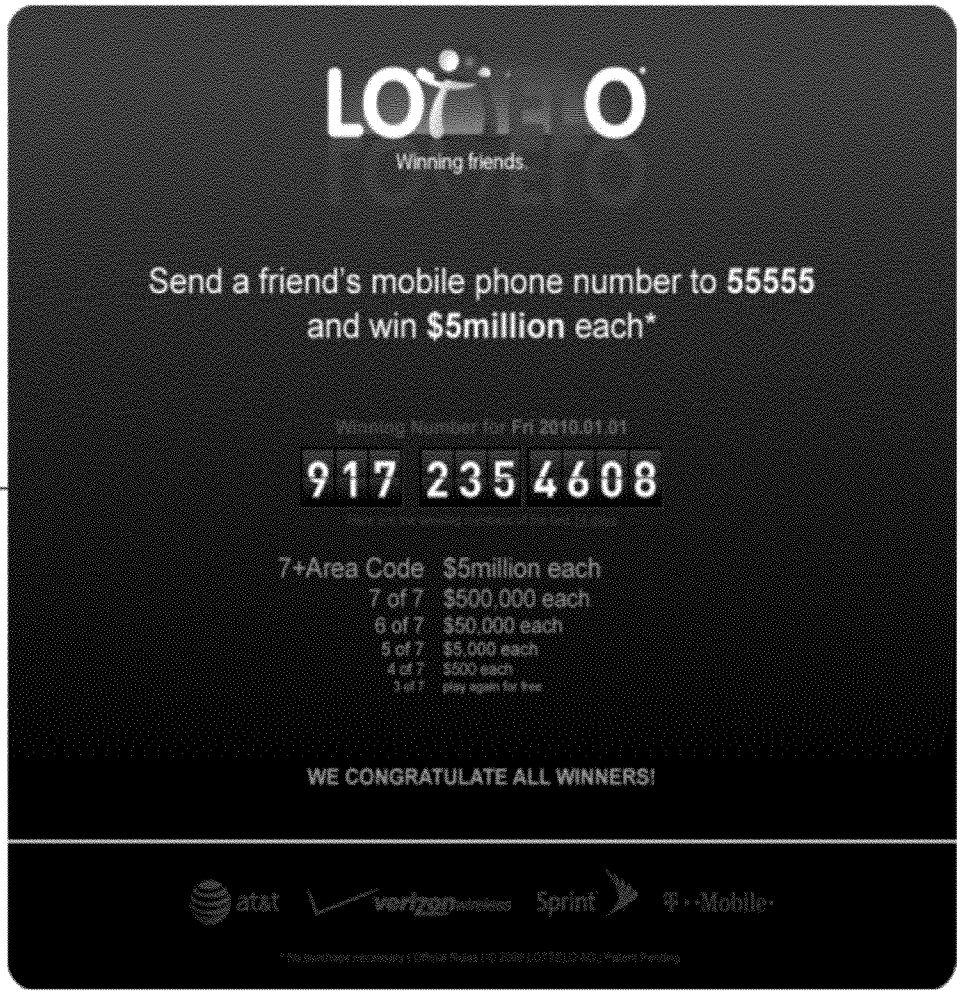
FIG. 8 is a screenshot of an alternative web page related to a game provided by the system of FIG. 2 or other systems for providing a game of chance over messaging services.

FIG. 8 is a screenshot of an alternative web page 800 related to a game provided by the system of FIG. 2 or other systems for providing a game of chance over messaging services. The alternative web page 800 may be representative of a game of chance configured such that if a phone number wins, both the user who was registered with the phone number, and the user who registered that user, win a prize. The alternative web page 800 may include the phone number the users 120A-N send messages to in order to participate in the game of chance. For example, a user A 120A may participate in the game by sending a mobile message to the phone number. The alternative web page 800 may also include the winning phone number for a particular date, such as 2010.01.01. The alternative web page 800 may also include the amount of the prize won by both the user who was registered with the phone number and the user who registered that user. The alternative web page 800 demonstrates that the prize may vary depending upon the amount that a phone number matches the winning phone number.

FIG. 9 illustrates a general computer system 900, which may represent the game server 340, the third party server 350, the mobile devices 320AA-NN, the MNO gateway servers 315A-N or any of the other computing devices referenced herein. The computer system 900 may include a set of instructions 924 that may be executed to cause the computer system 900 to perform any one or more of the methods or computer based functions disclosed herein. The computer system 900 may operate as a standalone device or may be connected, e.g., using a network, to other computer systems or peripheral devices.

In a networked deployment, the computer system may operate in the capacity of a server or as a client user computer in a server-client user network environment, or as a peer computer system in a peer-to-peer (or distributed) network environment. The computer system 900 may also be implemented as or incorporated into various devices, such as a personal computer (PC), a tablet PC, a set-top box (STB), a personal digital assistant (PDA), a mobile device, a palmtop computer, a laptop computer, a desktop computer, a communications device, a wireless telephone, a land-line telephone, a control system, a camera, a scanner, a facsimile machine, a printer, a pager, a personal trusted device, a web appliance, a network router, switch or bridge, or any other machine capable of executing a set of instructions 924 (sequential or otherwise) that specify actions to be taken by that machine In a particular embodiment, the computer system 900 may be implemented using electronic devices that provide voice, video or data communication. Further, while a single computer system 900 may be illustrated, the term "system" shall also be taken to include any collection of systems or subsystems that individually or jointly execute a set, or multiple sets, of instructions to perform one or more computer functions.

As illustrated in FIG. 9, the computer system 900 may include a processor 902, such as, a central processing unit (CPU), a graphics processing unit (GPU), or both. The processor 902 may be a component in a variety of systems. For example, the processor 902 may be part of a standard personal computer or a workstation. The processor 902 may be one or more general processors, digital signal processors, application specific integrated circuits, field programmable gate arrays, servers, networks, digital circuits, analog circuits, combinations thereof, or other now known or later developed devices for analyzing and processing data. The processor 902 may implement a software program, such as code generated manually (i.e., programmed).

The computer system 900 may include a memory 904 that can communicate via a bus 908. The memory 904 may be a main memory, a static memory, or a dynamic memory. The memory 904 may include, but may not be limited to computer readable storage media such as various types of volatile and non-volatile storage media, including but not limited to random access memory, read-only memory, programmable read-only memory, electrically programmable read-only memory, electrically erasable read-only memory, flash memory, magnetic tape or disk, optical media and the like. In one case, the memory 904 may include a cache or random access memory for the processor 902. Alternatively, the memory 904 may be separate from the processor 902, such as a cache memory of a processor, the system memory, or other memory. The memory 904 may be an external storage device or database for storing data. Examples may include a hard drive, compact disc ("CD"), digital video disc ("DVD"), memory card, memory stick, floppy disc, universal serial bus ("USB") memory device, or any other device operative to store data. The memory 904 may be operable to store instructions 924 executable by the processor 902. The functions, acts or tasks illustrated in the figures or described herein may be performed by the programmed processor 902 executing the instructions 924 stored in the memory 904. The functions, acts or tasks may be independent of the particular type of instructions set, storage media, processor or processing strategy and may be performed by software, hardware, integrated circuits, firm-ware, micro-code and the like, operating alone or in combination. Likewise, processing strategies may include multiprocessing, multitasking, parallel processing and the like.

The computer system 900 may further include a display 914, such as a liquid crystal display (LCD), an organic light emitting diode (OLED), a flat panel display, a solid state display, a cathode ray tube (CRT), a projector, a printer or other now known or later developed display device for outputting determined information. The display 914 may act as an interface for the user to see the functioning of the processor 902, or specifically as an interface with the software stored in the memory 904 or in the drive unit 906.

Additionally, the computer system 900 may include an input device 912 configured to allow a user to interact with any of the components of computer system 900. The input device 912 may be a number pad, a keyboard, or a cursor control device, such as a mouse, or a joystick, touch screen display, remote control or any other device operative to interact with the computer system 900.

The computer system 900 may also include a disk or optical drive unit 906. The disk drive unit 906 may include a computer-readable medium 922 in which one or more sets of instructions 924, e.g. software, can be embedded. Further, the instructions 924 may perform one or more of the methods or logic as described herein. The instructions 924 may reside completely, or at least partially, within the memory 904 and/or within the processor 902 during execution by the computer system 900. The memory 904 and the processor 902 also may include computer-readable media as discussed above.

The present disclosure contemplates a computer-readable medium 922 that includes instructions 924 or receives and executes instructions 924 responsive to a propagated signal; so that a device connected to a network 335 may communicate voice, video, audio, images or any other data over the network 335. Further, the instructions 924 may be transmitted or received over the network 335 via a communication interface 918. The communication interface 918 may be a part of the processor 902 or may be a separate component. The communication interface 918 may be created in software or may be a physical connection in hardware. The communication interface 918 may be configured to connect with a network 335, external media, the display 914, or any other components in computer system 900, or combinations thereof. The connection with the network 335 may be a physical connection, such as a wired Ethernet connection or may be established wirelessly as discussed below. Likewise, the additional connections with other components of the computer system 900 may be physical connections or may be established wirelessly.

The network 335 may include wired networks, wireless networks, or combinations thereof. The wireless network may be a cellular telephone network, an 802.11, 802.16, 802.20, or WiMax network. Further, the network 335 may be a public network, such as the Internet, a private network, such as an intranet, or combinations thereof, and may utilize a variety of networking protocols now available or later developed including, but not limited to TCP/IP based networking protocols.

The computer-readable medium 922 may be a single medium, or the computer-readable medium 922 may be a single medium or multiple media, such as a centralized or distributed database, and/or associated caches and servers that store one or more sets of instructions. The term "computer-readable medium" may also include any medium that may be capable of storing, encoding or carrying a set of instructions for execution by a processor or that may cause a computer system to perform any one or more of the methods or operations disclosed herein.

The computer-readable medium 922 may include a solid-state memory such as a memory card or other package that houses one or more non-volatile read-only memories. The computer-readable medium 922 also may be a random access memory or other volatile re-writable memory. Additionally, the computer-readable medium 922 may include a magneto-optical or optical medium, such as a disk or tapes or other storage device to capture carrier wave signals such as a signal communicated over a transmission medium. A digital file attachment to an e-mail or other self-contained information archive or set of archives may be considered a distribution medium that may be a tangible storage medium. Accordingly, the disclosure may be considered to include any one or more of a computer-readable medium or a distribution medium and other equivalents and successor media, in which data or instructions may be stored.

Alternatively, dedicated hardware implementations, such as application specific integrated circuits, programmable logic arrays and other hardware devices, may be constructed to implement one or more of the methods described herein. Applications that may include the apparatus and systems of various embodiments may broadly include a variety of electronic and computer systems. One or more embodiments described herein may implement functions using two or more specific interconnected hardware modules or devices with related control and data signals that may be communicated between and through the modules, or as portions of an application-specific integrated circuit. Accordingly, the present system may encompass software, firmware, and hardware implementations.

The methods described herein may be implemented by software programs executable by a computer system. Further, implementations may include distributed processing, component/object distributed processing, and parallel processing. Alternatively, virtual computer system processing maybe constructed to implement one or more of the methods or functionality as described herein.

Although components and functions are described that may be implemented in particular embodiments with reference to particular standards and protocols, the components and functions are not limited to such standards and protocols. For example, standards for Internet and other packet switched network transmission (e.g., TCP/IP, UDP/IP, HTML, HTTP) represent examples of the state of the art. Such standards are periodically superseded by faster or more efficient equivalents having essentially the same functions. Accordingly, replacement standards and protocols having the same or similar functions as those disclosed herein are considered equivalents thereof.

The illustrations described herein are intended to provide a general understanding of the structure of various embodiments. The illustrations are not intended to serve as a complete description of all of the elements and features of apparatus, processors, and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

Although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, may be apparent to those of skill in the art upon reviewing the description.

The Abstract is provided with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiments, which fall within the true spirit and scope of the description. Thus, to the maximum extent allowed by law, the scope is to be determined by the broadest permissible interpretation of the following claims and their equivalents, and shall not be restricted or limited by the foregoing detailed description.

What is claimed is:

1. A computer implemented method for providing a game of chance over messaging services, the method comprising:

receiving a first message from a first user, the first user being identified by a first identifier, wherein the first message comprises a second identifier of a second user;

registering the second user into a game of chance based on the first identifier of the first user;

sending a second message to the second user, wherein the second message invites the second user to register an identifier of another user into the game of chance;

determining, by a processor, a winning identifier from a plurality of identifiers; and sending a winning message to the second user if an amount by which the first identifier of the first user matches the winning identifier satisfies a winning threshold, wherein the winning message comprises an indication that the second user wins a prize.

2. The method of claim 1 wherein sending the second message to the second user further comprises sending the second message to the second user, wherein the second message invites the second user to register the first user into the game of chance by responding with a confirmation response.

3. The method of claim 2 further comprising:

receiving, from the second user, the confirmation response; and registering the first user into the game of chance based on the identifier of the second user.

4. The method of claim 1 wherein the amount satisfies the winning threshold if the identifier of the first user is equivalent to the winning identifier.

5. The method of claim 1 further comprising sending, by the processor, the winning message to the first user if the amount by which the identifier of the first user matches the winning identifier satisfies the winning threshold, wherein the winning message comprises the indication that the second user won the prize.

6. The method of claim 1 further comprising sending the second message to the first user, wherein the second message invites the first user to enter another user into the game of chance.

7. The method of claim 1 wherein determining, by the processor, the winning identifier from the plurality of identifiers further comprises determining, by the processor, a plurality of winning identifiers from the plurality of identifiers, further wherein a prize value is associated with each of the plurality of winning identifiers.

8. The method of claim 7 further comprising sending the winning message to the second user if the amount by which the first identifier of the first user matches any of the plurality of winning identifiers satisfies the winning threshold.

9. The method of claim 1 further comprising sending a notification message to the first user, wherein the notification message notifies the first user of the game of chance.

10. The method of claim 1 wherein the identifier of the first user comprises a phone number of the first user and the winning identifier comprises a winning phone number.

11. The method of claim 10 wherein the amount satisfies the winning threshold if the phone number of the first user matches a determined number of digits of the winning phone number.

12. The method of claim 10 wherein determining, by the processor, the winning identifier from the plurality of identifiers further comprises, selecting, by the processor, the winning phone number from a plurality of active phone numbers which share a country code with the phone number of the first user.

13. The method of claim 10 wherein determining, by the processor, the winning identifier further comprises, selecting, by the processor, the winning phone number from a plurality of active phone numbers in a geographic region where the phone number of the first user originates from.

14. The method of claim 1 wherein an amount of the prize is determined based on the amount by which the identifier of the first user matches the winning identifier.

15. The method of claim 14 wherein the amount of the prize increases as the amount by which the identifier of the first user matches the winning identifier increases.

16. The method of claim 1 wherein the prize comprises a monetary amount.

17. The method of claim 16 further comprising sending, by the processor, an electronic payment of the monetary amount to the second user if the amount by which the identifier of the first user matches the winning identifier satisfies the winning threshold.

18. A computer implemented method for providing a game of chance over messaging services, the method comprising:

receiving a first message from a first user, the first message comprising an identifier of a second user;

registering the second user into a game of chance based on the identifier of the second user;

sending a second message to the second user, wherein the second message invites the second user to register an identifier of another user into the game of chance;

determining, by a processor, a winning identifier from a plurality of identifiers; and sending a winning message to the second user if an amount by which the identifier of the second user matches the winning identifier satisfies a winning threshold, wherein the winning message comprises an indication that the second user won a prize.

19. The method of claim 18 further comprising registering the first user into the game of chance based on the identifier of the second user.

20. A non-transitory computer readable medium, the computer readable medium comprising instructions for:

receiving a first message from a first user, the first user being identified by a first identifier, wherein the first message comprises a second identifier of a second user;

registering the second user into a game of chance based on the first identifier of the first user;

sending a second message to the second user, wherein the second message invites the second user to register an identifier of another user into the game of chance;

determining, by a processor, a winning identifier from a plurality of identifiers; and sending a winning message to the second user if an amount by which the first identifier of the first user matches the winning identifier satisfies a winning threshold, wherein the winning message comprises an indication that the second user wins a prize.

21. The non-transitory computer readable medium of claim 20 wherein the instructions for sending the second message to the second user further comprise instructions for sending the second message to the second user, wherein the second message invites the second user to register the first user into the game of chance by responding with a confirmation response.

22. The non-transitory computer readable medium of claim 21 further comprising instructions for:

receiving, from the second user, the confirmation response; and registering the first user into the game of chance based on the identifier of the second user.

23. The non-transitory computer readable medium of claim 20 wherein the amount satisfies the winning threshold if the identifier of the first user is equivalent to the winning identifier.

24. The non-transitory computer readable medium of claim 20 further comprising instructions for sending, by the processor, the winning message to the first user if the amount by which the identifier of the first user matches the winning identifier satisfies the winning threshold, wherein the winning message comprises the indication that the second user won the prize.

25. The non-transitory computer readable medium of claim 20 further comprising instructions for sending the second message to the first user, wherein the second message invites the first user to enter another user into the game of chance.

* * * * *